US010417698B2

(12) United States Patent
Tisler et al.

(10) Patent No.: US 10,417,698 B2
(45) Date of Patent: Sep. 17, 2019

(54) AUCTION SYSTEM AND METHOD

(71) Applicants: Christopher David Tisler, Chino, CA (US); Jered John Johnson, Chino, CA (US)

(72) Inventors: Christopher David Tisler, Chino, CA (US); Jered John Johnson, Chino, CA (US)

(73) Assignee: Spread Group Inc., San Francisco, CA (US)

( * ) Notice: Subject to any disclaimer, the term of this patent is extended or adjusted under 35 U.S.C. 154(b) by 635 days.

(21) Appl. No.: 14/997,415

(22) Filed: Jan. 15, 2016

(65) Prior Publication Data

US 2016/0210690 A1 Jul. 21, 2016

Related U.S. Application Data

(60) Provisional application No. 62/104,004, filed on Jan. 15, 2015.

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
CPC ..... G06Q 30/08
USPC ..... 705/26, 27, 37
See application file for complete search history.

(56) References Cited

U.S. PATENT DOCUMENTS 7,555,445 B2 * 6/2009 Moya ..... G06Q 30/08 705/26.3
8,086,518 B1 * 12/2011 Maor ..... G06Q 30/08 705/37
2002/0049664 A1 4/2002 Hoffman et al.
2003/0018560 A1 * 1/2003 Dietrich ..... G06Q 30/0601 705/37
2003/0216959 A1 * 11/2003 Vitti ..... G06Q 30/02 705/14.39
2005/0197950 A1 * 9/2005 Moya ..... G06Q 30/08 705/37

(Continued)

OTHER PUBLICATIONS

Patent; Agency Reviews Patent Application Approval Request for Fantasy Sport Auction Draft Application, Computer Weekly News , Oct. 31, 2013; Dialog #1444052977, 6ogs. (Year: 2013).*

(Continued)

*Primary Examiner* — Robert M Pond

(57) ABSTRACT

The present system and method provides a unique and fast-paced method of auctioning multiple units concurrently. An auction group is created within the server, being made up of a plurality of, preferably homologous, units. All units within the auction group are concurrently auctioned in a primary auction, with each unit being bid upon within cooccurring separate sub-auctions within an auction period. Each bidding user has the opportunity to bid within one or more sub-auctions. Upon receiving a high bid within a particular sub-auction, a high bid period for that sub-auction is initiated, within which a counterbid must be received or the unit within that sub-auction will be awarded to the high bidding user. The sub-auctions may individually end prior to the expiration of the auction period. Successive primary auctions can be initiated, so that the user may obtain one or more units within each primary auction.

11 Claims, 8 Drawing Sheets

(56) References Cited

U.S. PATENT DOCUMENTS

| | | | | |
|---|---|---|---|---|
| 2006/0122929 | A1 | 6/2006 | Schoen et al. | |
| 2007/0054718 | A1* | 3/2007 | Del Prado | A63F 13/537 463/1 |
| 2007/0203824 | A1 | 8/2007 | Whelchel et al. | |
| 2008/0234048 | A1 | 9/2008 | Gottlieb | |
| 2009/0076926 | A1* | 3/2009 | Zinberg | G06Q 30/0601 705/26.1 |
| 2012/0071219 | A1* | 3/2012 | Belmarch | A63F 13/828 463/2 |
| 2013/0179293 | A1* | 7/2013 | Rabenold | G06Q 30/0601 705/26.3 |
| 2014/0164162 | A1* | 6/2014 | Rabenold | G06Q 30/08 705/26.3 |

OTHER PUBLICATIONS

PCT International Search Report; dated Mar. 24, 2016 (Enclosed herein).

* cited by examiner

AUCTION SYSTEM AND METHOD

RELATED APPLICATION DATA

This application claims the priority date of provisional application No. 62/104,004 filed on Jan. 15, 2015, which is herein incorporated by reference in its entirety.

BACKGROUND

The present disclosure relates generally to auctions for bidding on virtual or real items, and more particularly, bidding on groups of items.

Auctions are often fast-moving and exciting. However, the ability to increase the number of items auctioned during a given period is limited by current auction methods. A method of auctioning a number of items concurrently is needed to increase the speed and excitement of the auction process.

SUMMARY

A method of concurrently auctioning a first unit and a second unit, under control of one or more computing systems configured with executable instructions, is presented herein. The present method and system enables the speedy and exciting auction of multiple units within an auction group, where each bidder has the opportunity to bid and be awarded one or more units within the auction group. The users can bid on successive and separate auction groups of units, preferably being awarded one unit per auction group. The units obtained by each user bidding in each of a succession of auction groups can be combined together into a team of units, preferably one unit is obtained in each auction group.

In a first embodiment, the present method includes the steps of communicating, from the server, a homologous auction group to a first computer and a second computer, the homologous auction group includes the first unit and the second unit; initiating, by the server, an auction period, with a first sub-auction and a second sub-auction at least partially cooccurring during the auction period, the first sub-auction being restricted to the first unit and a second sub-auction being restricted to the second unit; and communicating permission, from the server, to the first computer and the second computer, to each concurrently place bids on the first sub-auction and the second sub-auction during the auction period, where competing bids can be placed on the first unit within the first sub-auction and the second unit within the second sub-auction.

Optionally, the auction group is a player position on a virtual team, the first unit is a first virtual player and the second unit is a second virtual player. An award notification is communicated from the server to the first computer and the second computer, the award notification awarding the first virtual player to the first user profile and the second virtual player to the second user profile. A second auction period is initiated by the server, where a third sub-auction and a fourth sub-auction at least partially cooccur during the second auction period; the first sub-auction is restricted to a third virtual player and a second sub-auction being restricted to a fourth virtual player, where the second auction period being carried out by similar steps to the auction period. A second award notification is communicated from the server to the first computer and the second computer, the second award notification awarding the third virtual player to the first user profile and the fourth virtual player to the second user profile. A first user team is assembled by the server including the first virtual player and the third virtual player. A second user team is assembled by the server including the second virtual player and the fourth virtual player.

In yet another embodiment, a method of concurrently auctioning a first unit and a second unit is presented. The method can include the steps of grouping, by the server, the first unit and the second unit into an auction group comprising the first unit and the second unit; communicating, from a server, the auction group with a first description of the first unit and a second description of the second unit, to a first computing device associated with a first user profile and a second computing device associated with a second user profile; initiating, by the server, an auction period for the auction group, during which competing bids are permitted to be received from the first computing device and the second computing device, a first sub-auction being restricted to the first unit and a second sub-auction being restricted to the second unit, the first sub-auction and the second sub-auction occurring during the auction period; granting permission, by the server, to the first user profile and the second user profile, to concurrently place bids on the first sub-auction and the second sub-auction during the auction period, where competing bids can be placed on the first unit within the first sub-auction and the second unit within the second sub-auction; receiving, from the first computing device and the second computing device, competing bids on the first unit within the first sub-auction; receiving, from the first computing device, a high bid on the first unit; and communicating, from the server, an award notification to the first computing device and the second computing device, the award notification awarding the first unit to the first user profile and the second unit to the second user profile.

Optionally, the auction group is homologous. The auction group may also be a player position on a virtual team, where the first unit is a first virtual player and the second unit is a second virtual player.

The method can optionally further include the steps of receiving, from the first computing device and the second computing device, competing bids on the second unit within the second sub-auction; and receiving, from the second computing device, a second computing device high bid on the second unit. The auction group may further comprises a third unit, a third sub-auction being restricted to the third unit, the third unit not being awarded if a bid is not received within the third sub-auction. The method may further include the steps of granting permission, by the server, to the first user profile, the second user profile, and a third user profile associated with a third computing device, to further concurrently place bids on a third sub-auction during the auction period, where competing bids can be further placed on the third unit within the third sub-auction; failing to receive a third computing device high bid, from the third computer, on the first sub-auction, second sub-auction, and the third sub-auction; and communicating, from the server, a default award notification to the first computing device, the second computing device, and the third computing device, the default award notification awarding the third unit to the third user profile.

The step of receiving a high bid on the first unit can optionally further include initiating a first sub-auction high bid period, during which the second user profile is granted permission, by the server, to place a counterbid on the first unit. The server may set a first sub-auction first minimum bid increment on the first sub-auction. The method may further include the steps of receiving, from the second computing device, the counterbid on the first unit; initiating a first sub-auction second high bid period, during which the first user profile is granted permission, by the server, to place a second counterbid on the first unit; receiving, from the first computing device, the second counterbid on the first unit; initiating a first sub-auction third high bid period, during which the second user profile is granted permission, by the server, to place a third counterbid on the first unit; ending the first sub-auction third high bid period when the third counterbid is not received, by the server, from the second computer; and terminating, by the server, permission to place bids within the first sub-auction, while continuing permission to place bids within the second sub-auction. As an option, prior to the step of terminating permission to place bids within the first sub-auction, the server may set a second sub-auction first minimum counterbid increment on the first sub-auction.

A current high bid can optionally be received, by the server, on the first unit within the first sub-auction transmitted through either the first user profile or the second user profile during the auction period, the current high bid capable of being exceeded by a counterbid, where the steps further include receiving bid activity during a predetermined time period just prior to an end of the auction period; and initiating an overtime period, during which a first confidential bid is received, by the server, from the first computing device and a second confidential bid is received, by the server, from the second computing device, wherein the first confidential bid is the high bid.

DESCRIPTION OF THE PREFERRED EMBODIMENTS

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

Figures 1, 2:
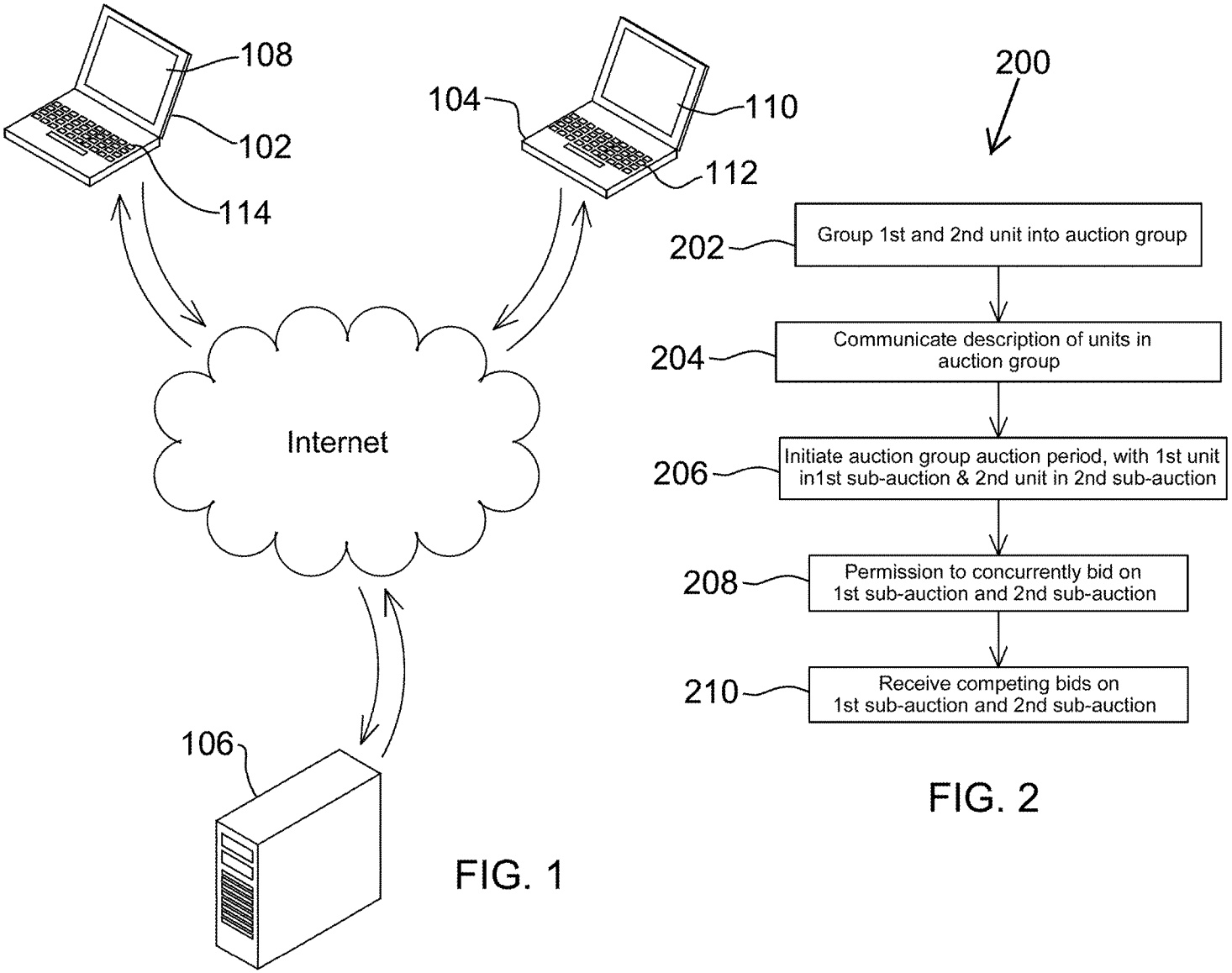
FIG. 1 illustrates an example network, with a server having programs encoded on computer storage devices and configured to perform the actions of the methods, and two client computers connected to the server or other computing means through the Internet.
FIG. 2 depicts a flow chart that describes methods steps that may be performed by a server or other computing means for performing a group auction, in accordance with one embodiment.

FIG. 1 illustrates an example of a computer network (100) with client computers (first computing device 102, and second computing device 104) and a server (106) on which any of the methods and systems of various embodiments may be implemented. Computing device is intended to represent various forms of desktop devices and mobile devices, such as personal digital assistants, cellular telephones, smartphones, tablets, and other similar computing devices. In particular the computer system, or server (106) in this example, may represent any of the computer systems and physical components necessary to perform the computerized methods discussed in connection with FIGS. 2-12 and, in particular, may represent a server (cloud, array, etc.), client, or other computer system upon which e-commerce servers, websites, web browsers and/or web analytic applications may be instantiated.

The illustrated exemplary server (106) is known to a person of ordinary skill in the art, and may include a processor, a bus for communicating information, a main memory coupled to the bus for storing information and instructions to be executed by the processor and for storing temporary variables or other intermediate information during the execution of instructions by processor, a static storage device or other non-transitory computer readable medium for storing static information and instructions for the processor, and a storage device, such as a hard disk, may also be provided and coupled to the bus for storing information and instructions. The server (106) may be optionally coupled to a display for displaying information. However, in the case of servers, such a display may not be present and all administration of the server may be via remote clients. Further, the server (106) may optionally include an input device for communicating information and command selections to the processor, such as a keyboard, mouse, touchpad, and the like.

The server (106) may also include a communication interface coupled to the bus, for providing two-way, wired and/or wireless data communication to and from the server (106). For example, the communications interface may send and receive signals via a local area network or other network, including the Internet. Program code embodied on a computer readable medium may be transmitted using any appropriate medium, including but not limited to wireless, wireline, optical fiber cable, RF, etc., or any suitable combination of the foregoing.

In the present illustrated example, the hard drive of the server (106) is encoded with executable instructions, that when executed by a processor cause the processor to perform acts as described in the methods of FIGS. 2-12. The server (106) communicates through the Internet with one or both of the first computing device (102) and the second computing device (104) to cause information and/or graphics to be displayed on the screens (108, 110). A first user may enter information for communication to the server (106) through the keyboard (114), mouse, touchscreen, voice, or other appropriate data entry device. Likewise, a second user may enter information for communication to the server (106) through the keyboard (112). Information transmitted to the server (106) by either the first computing device (102) or the second computing device (104) may be stored on the server (106) for use in calculations, creation of documents, charging fees, initiating further communications, or for other purposes.

FIG. 2 is a flow diagram of an exemplary process (200) for conducting an auction for concurrently bidding on a group of homologous or nonhomologous units, which may be performed on the server (106) or on the user's local computing device. The term homologous means that the units are similar in position, value, structure, or function, or have a related or similar position, structure, etc., but are not necessarily the same. The example detailed later below, includes a fantasy sports team, where the units within an auction are players of a particular position, but will generally have different skill levels and performance. However, the units may be physical objects or other virtual units, rather than virtual players on a fantasy or virtual sports team.

In the example process (200), the server (106) groups the first unit and the second unit into an auction group (202). The server (106) communicates descriptions of the auction group to the first computing device (102) and the second computing device (104), which can be displayed to the first user and the second user on the displays (108, 110) (204). The server (106) initiates an auction period where the first unit can be bid upon in a first sub-auction and, concurrently, the second unit can be bid upon in a second sub-auction by both the first user and the second user (206). During the auction period, the server grants the computing devices (102, 104) permission to transmit bids paced on one or both of the first sub-auction and the second sub-auction (208). For example, both the first user and the second user have the ability to place competing bids on the first unit within the first sub-auction, and/or the second unit, within the second sub-auction. Alternatively, the users can each place bids on separate units, never directly competing for the same unit or within the same sub-auction. Once bids are entered into the computing devices (102, 104), the bid data is transmitted and received by the server (106) (210).

Figure 3:
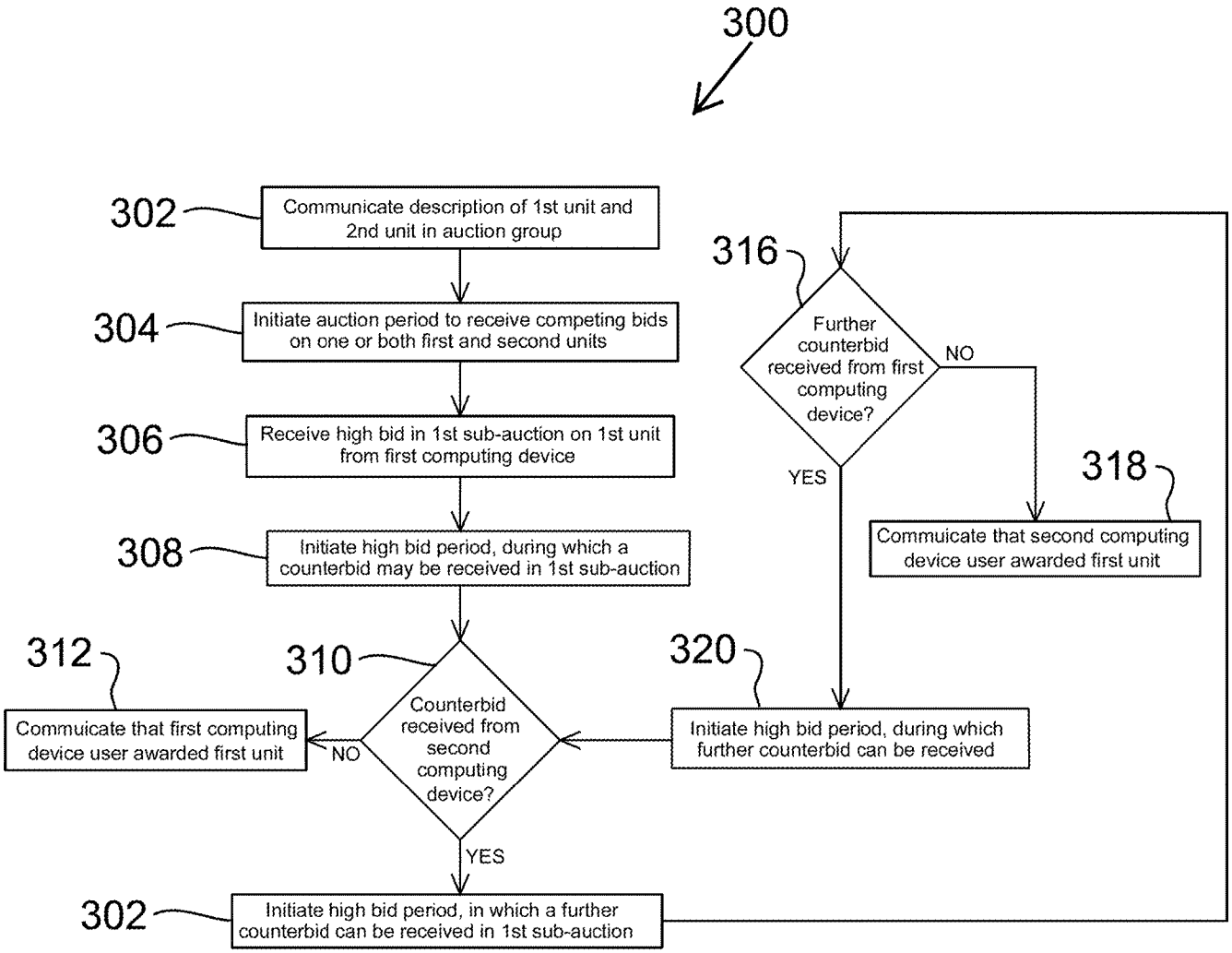
FIG. 3 depicts a flow chart that describes methods steps that may be performed by a server or other computing means for performing a group auction, in accordance with one embodiment.

FIG. 3 is a flow diagram of another exemplary process (300) for conducting an auction for a group of units, which may be performed on the server (106) or on the user's local computing device. In the example process (300), a description of the first unit and the second unit are communicated to the first computing device (102) and the second computing device (104). The units may be physical or virtual products, characters, or other concepts, real or virtual, which may be auctioned. In the present example embodiment, there are two units available for auction, bid upon by two users (one user for each computing device). However, there may be numerous units which may be simultaneously auctioned in accordance with the present methods and systems, such as five, ten units, or a hundred units; and there may be numerous users bidding on the same auction group and on either the same or differing units within the auction group. The descriptions are preferably displayed on the screens (108, 110) of the computing devices (102, 104) using one or both of text or graphics, as will be discussed in reference to the graphical user interface below. The currency used for the bidding may be real money (such as US dollars or Euros) or virtual money, where the value is determined by the system.

After communicating the description of the auction group (302), an auction period is initiated (304), where bids may be received from one or both of the first computing device (102) and the second computing device (104) on one or both of the first unit and the second unit. In one example auction, a high bid is received from the first computing device (108) on the first unit in the first sub-auction, as entered by the first user (306). A high bid period is initiated (308), where within a predetermined period of time, a counterbid may be received from the second computing device (104). The high bid period may be communicated to both computing devices (102, 104) by displaying a countdown timer, a five second timer for example, and/or changing the color of a portion of the display to alert both users that the unit on which the high bid has been received will be awarded to the high bidder unless a counterbid has been received by the non-high bidder.

A counterbid may optionally be received from the users that do not have the highest bid within a sub-auction during the high bid period (310). If no counterbid is received before the expiration of the high bid period, then it is communicated that the user associated with the first computing device is awarded the first unit (312). If a counterbid is received from the second computing device (104) during the high bid period, where the counterbid is greater than the high bid, a second high bid period is initiated (314), during which a counterbid may optionally be received from the first computing device (102). If a counterbid is received from the first computing device (102) during the second high bid period, where the counterbid is greater than the previous counterbid (the current high bid), another high bid period is initiated (320), during which a yet another counterbid may optionally be received from the second computing device (104). The process of bid-counterbid may be repeated within the sub-auction so long as the counterbid is received within a high bid period and the overall auction period has not expired. If no counterbid is received before the expiration of the high bid period, then it is communicated that the user associated with the second computing device (104) is awarded the first unit (318).

As mentioned above, although two units are auctioned simultaneously or concurrently in the above example auctions, it may be preferable to auction a dozen or so units simultaneously using the present method. For twelve units, the identity and information regarding each unit is displayed to all auction participants, preferably in a grid-like pattern, but other patterns are possible, such that the users can quickly determine the important details of each unit during the preview and auction periods. Additionally, there may be multiple users available for participation in the auction, such as 5 or 10 people, or more, depending on the auction. The group of units available for bidding may have a similar characteristic, with slight variations in quality, value, or amenities, such that there may be several highly valued units, several mid-valued units, several lesser-valued units, and possibly several units with an unknown or somewhat indeterminable value.

In an exemplary auction, each user may bid on a different or same unit, within each unit's respective sub-auction. For example, if there are 10 users and 12 units, each user theoretically may be awarded a unit, yet a user may choose not to bid or may underbid on one or more units. During an auction period on a group of units, several users may log one or more bids on a first unit, so that a sub-auction occurs on that first unit. While simultaneously, several users may enter bids on a second unit, creating yet another sub-auction. The users for both sub-auctions may also place bids on other units in other sub-auctions, such as for secondary or tertiary backup choices. In one example, when a particular user has obtained a high bid on a first unit, that user may be prohibited from placing a bid on another unit unless the user has been outbid with a counterbid from another user. However, the users may be permitted to have high bids on multiple units, or withdraw a high bid and place a bid on another unit.

Figure 4:
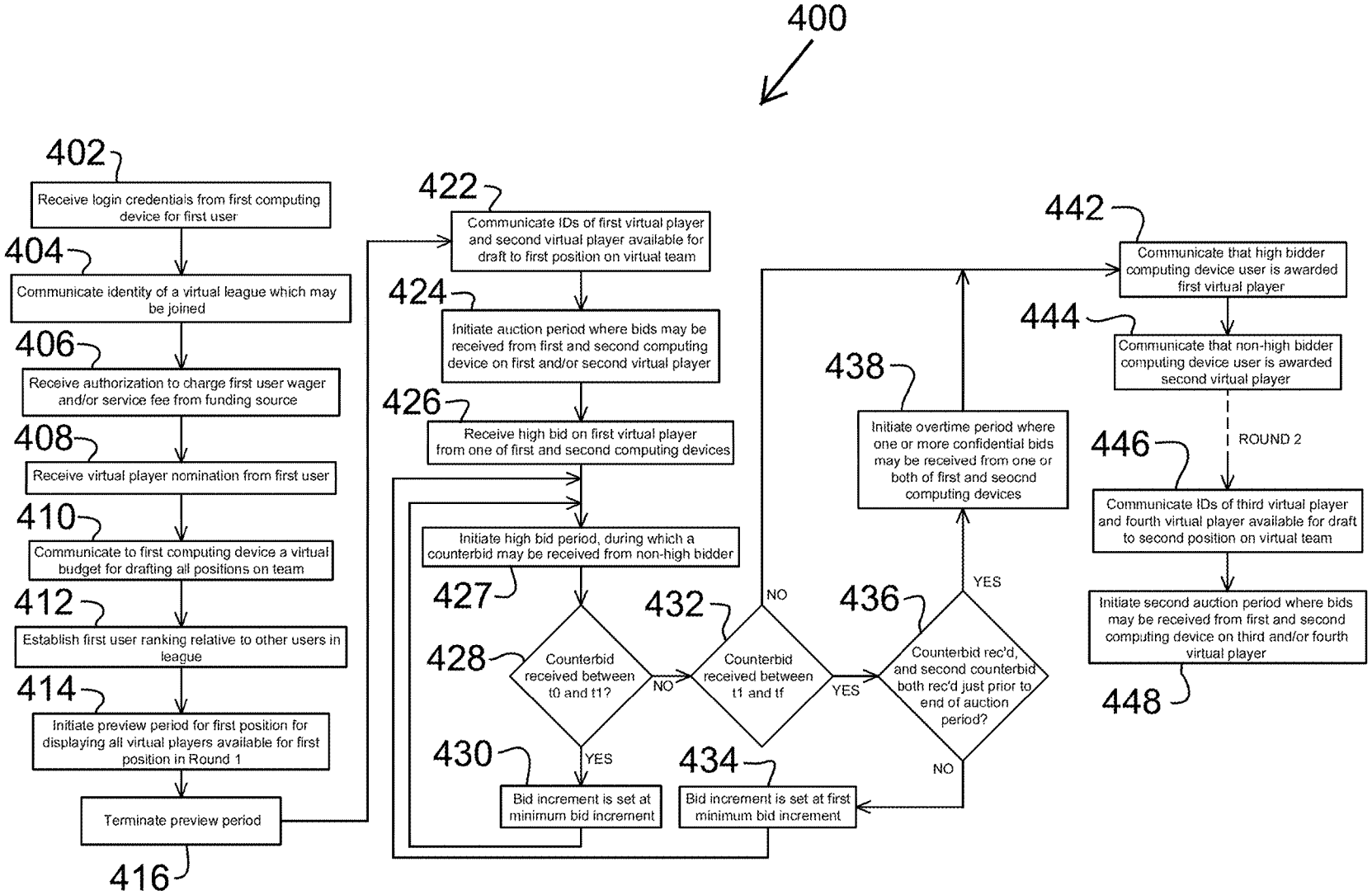
FIG. 4 depicts a flow chart that describes methods steps that may be performed by a server or other computing means for performing the initial stages of the auction process and through a first round auction of a first group of units, in accordance with one embodiment.

FIG. 4 is a flow diagram of an exemplary process (400) for preparing a user for the bidding process and for facilitating the auction for a particular virtual team position on a user's virtual team. Login credentials are received (402) from the first computing means (102) associated with a first user, such as a user name and password, or other identifying information.

The identity of a virtual league is communicated to the first computing device (102), where the virtual league has an open position which may be filled by the first user (404). Generally, an exemplary virtual league has a plurality of users, for example ten users, each associated with a computing device. Each user within a given league will participate in series of virtual player auctions within a larger auction period, as described herein, to fill player positions within the user's team. Once the auction is completed, the users should each have a virtual team comprised of a number of virtual players, each virtual player filling a particular position on the virtual team.

The auction may require payment of a service fee, other fees, an earnest money deposit, direct league entry fees, or other form of real money payment that would require receiving authorization to charge the fee from a credit card, bank, or other payment source, such as a user's account within the present system (406).

The present example auction is for virtual team members on a fantasy sports team within a fantasy league, where each competing user bids on virtual players for each position to create a team for competition within the fantasy league, such as a fantasy football league. However, this auction method and system may be applied to goods or any other item, real or virtual, which may be auctioned. In this example method, each user is able to enter a nomination for a virtual player for each position, where each nomination will be included in the auction for each particular position (408).

A virtual budget is communicated to the first user (410), where the virtual money within the virtual budget may applied to each respective position auction as the first user chooses. For example, the first user may be assigned a budget of 200 virtual dollars which must be divided and used to draft the first user's entire team. Each member of the virtual league similarly receives a virtual budget which is preferably equal, but may be unequal if desired. Optionally, the first user is assigned a ranking relative to the remaining users in the virtual league (412), for the purposes of a draw, the awarding of a default unit or virtual player, or other circumstances as described below. The ranking may be random or nonrandom (e.g., the user's playing record may increase or decrease ranking in one example).

Preferably, after a virtual league has been formed, a preview period is initiated for all users (414). Before each individual team position auction commences, all users are provided the option to view the virtual players available for that team position. For example, a first virtual player, a second virtual player, and a $n^{th}$ virtual player may be available for a first virtual position, where the $n^{th}$ player could be any number of players, for example ten virtual players. In this example, six virtual players for the quarterback (in the case of an American football virtual league) position are displayed to each of the users, which may include the virtual player nomination (see also, FIG. 6). The virtual player statistics, such as the name of a real football quarterback, his record, team, etc., may be displayed individual boxes arranged in a grid pattern, square array, or other arrangement. The users have a limited amount of time to view the virtual player profiles, for example five seconds, before preview period is terminated (416) and the auction period for the quarterback position begins immediately or shortly thereafter.

Figure 7:
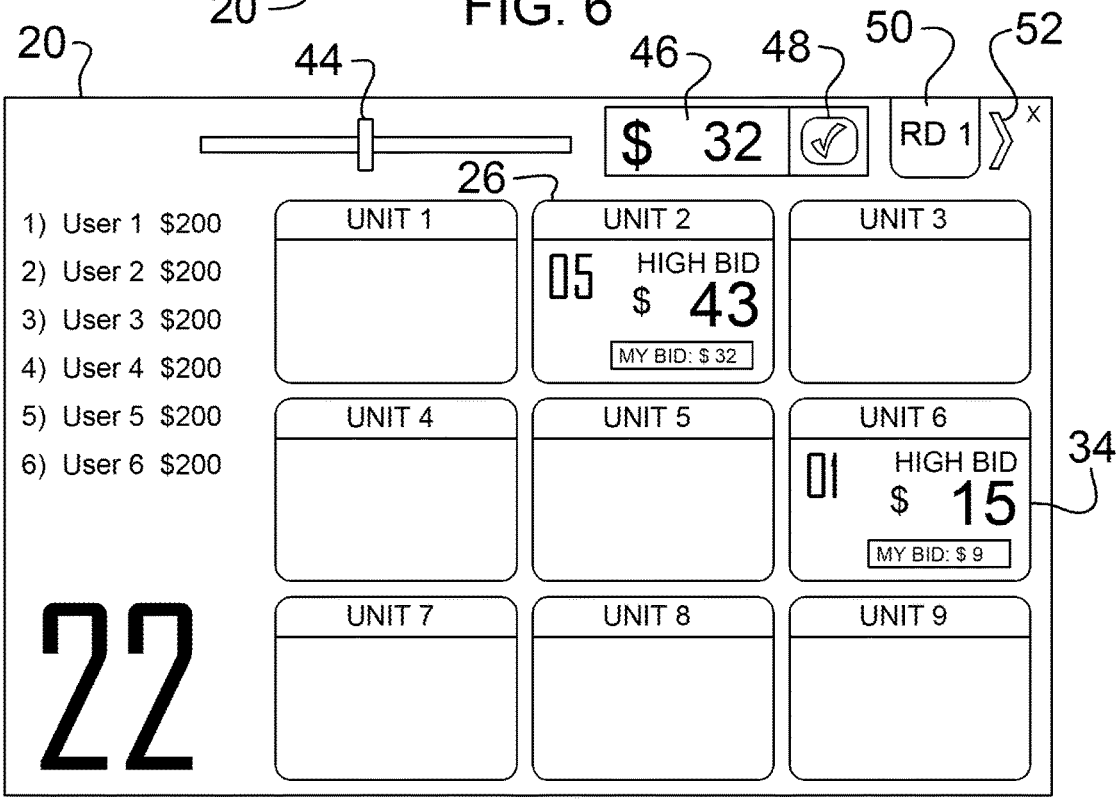
FIG. 7 depicts the graphical user interface, in the early stages of the group auction.
Figure 8:
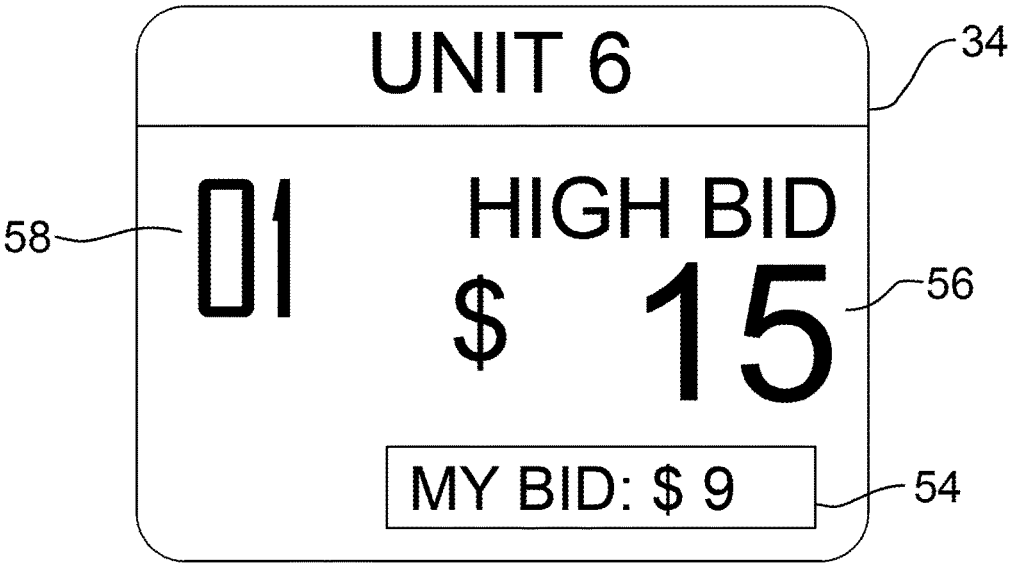
FIG. 8 depicts the graphical user interface, illustrating a magnified view of a sub-auction.

When the preview period expires, the same array of virtual player profiles preferably serves as the auction graphical user interface (GUI), such that the users would not be able to interact with the preview GUI in the preview period, but could interact with the auction GUI during the auction period, as seen in FIG. 7. The identities of the first virtual player and the second virtual players are communicated to the first computing device and the second computing device (422). Of course, the number of computing devices and users associated with the computing devices is not limited to two, and may be expanded to any number of users and their computing devices.

The first auction period for a first position is then initiated (424), where bids on one or both of the first and second virtual players may be received, as placed by one or both of the first and second users. In the illustrated example, a high bid is received from one of the first and second computing devices one the first virtual player (426). When a high bid is received by the server (106), a high bid period is initiated (427), where the high bidder may optionally be restricted from further bidding on any virtual player and the non-high bidder is given a limited period of time to enter a counterbid.

The bid increment may be adjusted within the auction or kept constant. During the first portion of the high bid period (for example, between $t_0$ and $t_1$) (428) the bid increment may be set at a minimum bid increment (430), where the bid increment is the minimum amount by which the bid will be raised for the counterbid. During a second portion of the high bid period (for example, between $t_1$ and $t_f$) (432) the bid increment may be set at a first minimum bid increment (434), where the first minimum bid increment is greater than the minimum bid increment. The high bid period may be divided into many portions, where the bid increment is raised or lowered in each portion, relative to the previous portion, preferably being raised. Moreover, the bid increment may be continuously changed as a function of time, for example, the bid increment may be raised or lowered incrementally or continuously throughout any of the high bid periods that may occur. If the bid increment is kept constant, then, using the flow chart of FIG. 4, the minimum bid increment would be equal to the first minimum bid increment.

Each user may counterbid to outbid the current high bidder during the high bid period; and this process may repeat itself until an iteration where the high bid period is permitted to expire without a counterbid (after $t_f$) within the sub-auction or when the auction period is permitted to expire without a counterbid. In this case, it is communicated to the high bidder's computing device that the first virtual player is awarded to the high bidder (442). In the case where there one only two users and two virtual players available for auction, it can be optionally communicated that the second virtual player is automatically awarded to the non-high bidder (444) or the second user did not win any virtual player for the round.

More likely, there will be many more users and virtual players than just two. In this case, the auction for the first position will continue. The ultimate high bidder will be awarded the first virtual player for his team's quarterback (or other) position, and, in one example embodiment, will no longer be able to bid on the remaining quarterback candidates. Further, the first virtual player within the first sub-auction can no longer be bid upon by the remaining users. The remaining users will continue to bid on the remaining virtual players within the remaining active sub-auction, with successive users and their awarded virtual players likewise being eliminated from the bidding pool, until each user has been awarded a virtual player for the quarterback position or has lost the opportunity to recruit a virtual quarterback, if no winning bids were placed.

In a preferred embodiment, there is a position auction timer which limits the time available for all users to obtain a virtual player for a given position in the auction period. For example, referring to the quarterback position, all users may be given one minute to bid on virtual players for the quarterback position. Similar to above, the bid increment may be adjusted at any time during this position auction period for the purposes of preventing delay and last-minute bidding. If the position auction period expires and just one user has not been awarded a virtual player, then the user may be assigned a virtual player for free, for the last bid placed, for a given fee, or other fee determination means. The virtual players for each position may be ranked according to the real-life statistics of the real player associated with the virtual player. In this way, the user who is not awarded a virtual player may be assigned a virtual player who has the highest ranking of the remaining (unassigned) virtual players. Similarly, if the first auction period expires and two users have not been awarded a virtual player, then virtual players are assigned to each user according to the user's rank or seed, where the highest ranked user is assigned the highest ranked unassigned virtual player, the second highest user is assigned the second highest ranked unassigned virtual player, and so on.

Figure 10:
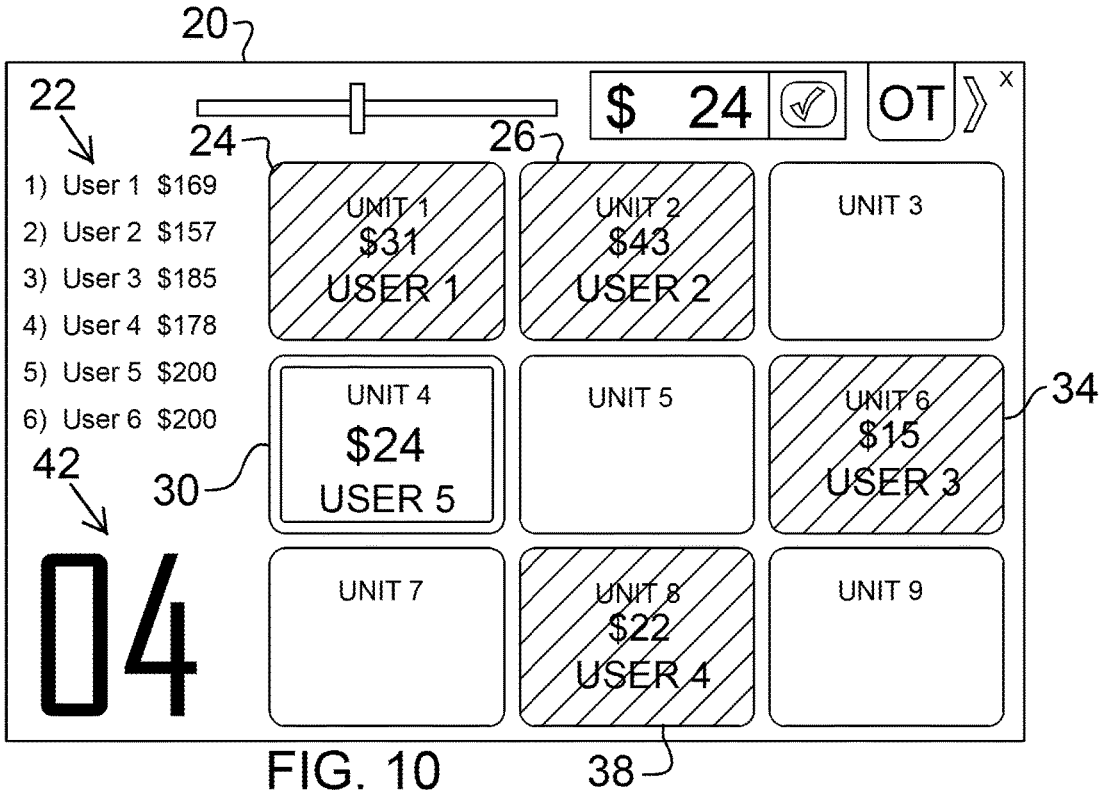
FIG. 10 depicts the graphical user interface, after the auction period has expired and an optional silent auction period is initiated.

An overtime period may be initiated (438) if bids or other bid activity (such as an invalid bid or a bid in error) are received from two or more computing devices during the final portion of the auction period (for example, two seconds prior to the end of the auction period). If the auction period is between $T_0$ and $T_f$, and a bid and counterbid (or two counterbids from different users) are received between $T_1$ and $T_f$ (within the final portion of the auction period, where the difference between $T_1$ and $T_f$ can be set for any time period, but approximately several seconds is preferred), then overtime period may be initiated. During the overtime period, the players who placed the bids in the final portion of the high bid period will each be given the opportunity to enter one or more confidential bids over a short period of time (for example, 5 seconds), where the highest confidential bidder is awarded the virtual player, as seen in FIG. 10. If two or more of the confidential high bids are equal, then the user with the highest ranking or seed will be awarded the virtual player.

After each user has been awarded or assigned a virtual player for the first position, the second position auction or second round may be immediately commenced or started after a brief period. In this case, the second position may be the point guard position. The identities of the third virtual player and the fourth virtual players available for the second position are communicated to the first computing device and the second computing device (446). And the second position is determined by auction as described in the above example of the first position auction (448). Once every position for each user's team has been filled, the teams within the virtual league may compete against one another for a given period of time, for example one week.

Figure 5:
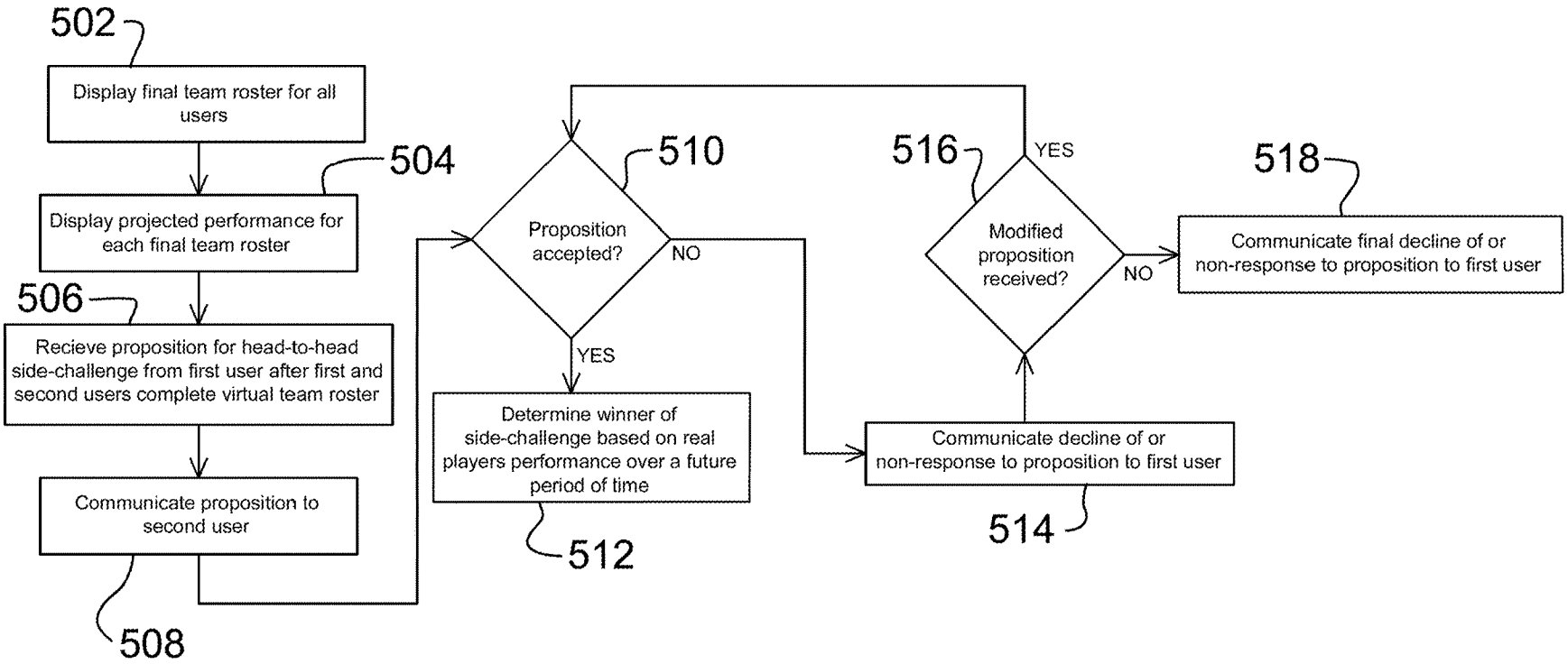
FIG. 5 depicts a flow chart that describes methods steps that may be performed by a server or other computing means for performing a side-challenge proposition.
Figure 12:
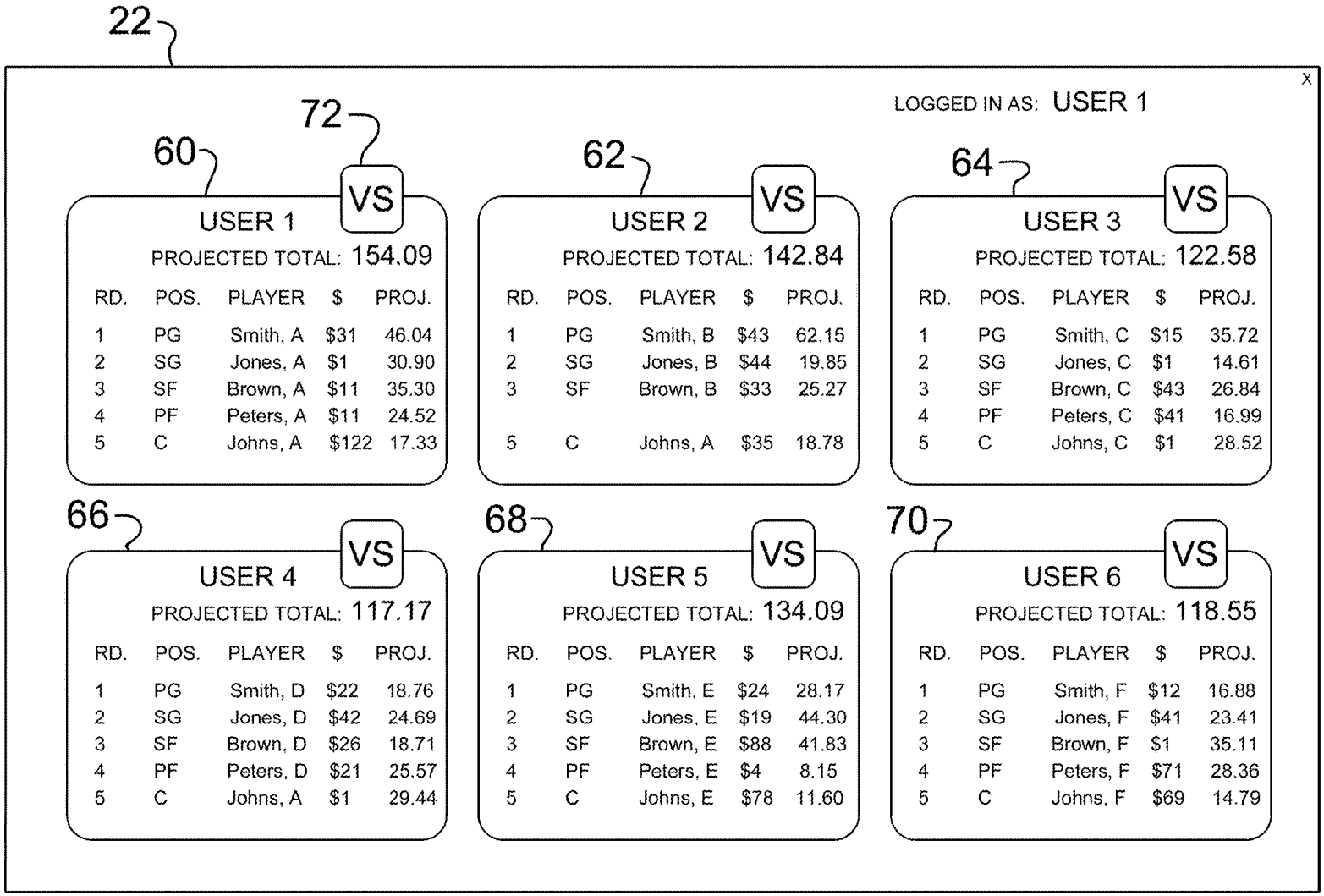
FIG. 12 depicts the graphical user interface, after each user has had an opportunity to obtain a unit over the course of multiple auction rounds, in this example, a fantasy sports team.

FIG. 5, and also referring to FIG. 12, is a flow diagram of an exemplary process (500) for performing a side-challenge proposition, where a first user may proposition a second user to a one-on-one or head-to-head challenge in addition to the league challenge. At the end of a series of auctions in which multiple users have built a virtual team made of virtual players for each position on the teams, a final team roster is communicated to all users' computing devices (502). Each virtual player is linked to a real player in a sport, such as a player for a professional football team, so that the statistics of the real player are utilized to determine the value and performance of the virtual player of the same name. Statistics and other data are received frequently from the servers of a third-party sports data and content provider, which are used to update the virtual player and predict possible future performance of the virtual player. The projected performance (over the course of a week or other period of time) of the each virtual player and each virtual team are displayed on each user's computer, so that all users can see the projected performance of the teams of all other users (504).

After viewing the projected performance of all users, the first user can proposition the second user to a head-to-head side-challenge (506, 508), with a proposition and handicap (such as scoring compensation to equalize the chance of a weaker player winning). If the proposition is accepted by the second user (510), then the winner of the side-challenge is determined by the actual performance of real-life athletes over a given time period (such as a day, week, or other time period) (512). If the proposition is not accepted by the second user (through decline or non-response), then the first user or second user may modify the proposition (516). If the modified proposition is declined, then this may be considered a final decline (518), closing the side-challenge proposition.

Figure 6:
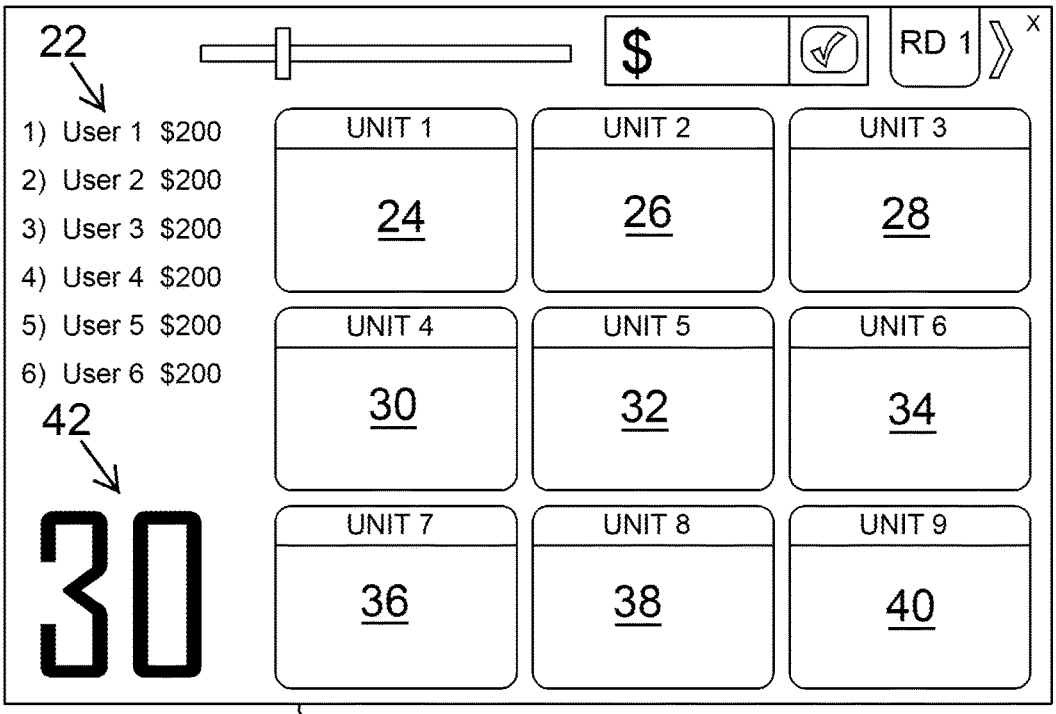
FIG. 6 depicts an embodiment graphical user interface, through which the present methods may be communicated, in a preview mode.

FIGS. 6-12 show exemplary graphical user interfaces (20) for use with the present auction method, for displaying the status of the auction on a display of a computing device and permitting a user to interact with the system by bidding and other operations. FIG. 6 illustrates the preview period, before the virtual player auction period. The user information area (22) in the upper left corner displays the user names, virtual money available, and seed ranks of all the users participating in the current league. During the preview period, the users are not permitted to bid. The users are permitted to view all of the units in the current group up for auction, each unit representing an available sub-auction. Here, there are nine sub-auction units (24-40) in a square grid pattern are illustrated. The units may be any type of item, or a virtual player as discussed above. A large, translucent countdown timer (not shown) may overlay the grid of units in the group. The GUI (20) may include a user comment or chat area, for communications between users at any time. To the lower left of the GUI is an auction countdown timer (42), showing 30 seconds in this example. Thus, once the auction begins, the users will have 30 seconds to win a virtual player by bidding, or else be assigned a player if time runs out before winning one by bidding. At the middle top of the GUI is a bid slider interface (44), where the user may slide the indicator along the white line to increase or decrease the bid amount displayed in the user bid box (46) next to the slider. The user should set the amount of the bid (shown next to a $ symbol) and select the confirm button (48) to enter the bid. The round indicator box (50) on the upper right hand corner describes the group of units being auctions, "RD 1" for round 1 in this case, but may be "QB" for quarterback, and so on. The chevron-shaped arrow (52) to the right of the round indicator box (50) permits the user to look ahead at the next group name, such as "RD 2" or "PG" for point guard.

FIG. 7 illustrates the GUI (20) at the beginning stage of the round 1 auction, from the point of view of the first user or user 1. The countdown timer is at 22 seconds and sub-auction units (26 and 34) are each receiving competing bids. The first user has placed a losing bid (seen as "My Bid") on sub-auction unit (34) and sub-auction unit (26). Looking at FIG. 8, the user sub-auction bid box (54) shows that the first user placed a $9 bid on Unit 6, within sub-auction unit (34). However, in the high bid area (56) a high bid of $15 is shown, besting the first user's $9 bid. The first user has the option of selecting sub-auction unit (34) and increasing the bid with a counterbid. A sub-auction counterbid timer (58) indicates that there is just one second remaining in which a counterbid from any user may be submitted. Viewing FIG. 9, it can be seen that Unit 6 has been rewarded; and the account of the third user or user 3 has been reduced by $15, to $185, indicating he was awarded Unit 6. The user awarded each unit may also be kept secret during the auction period.

Figure 9:
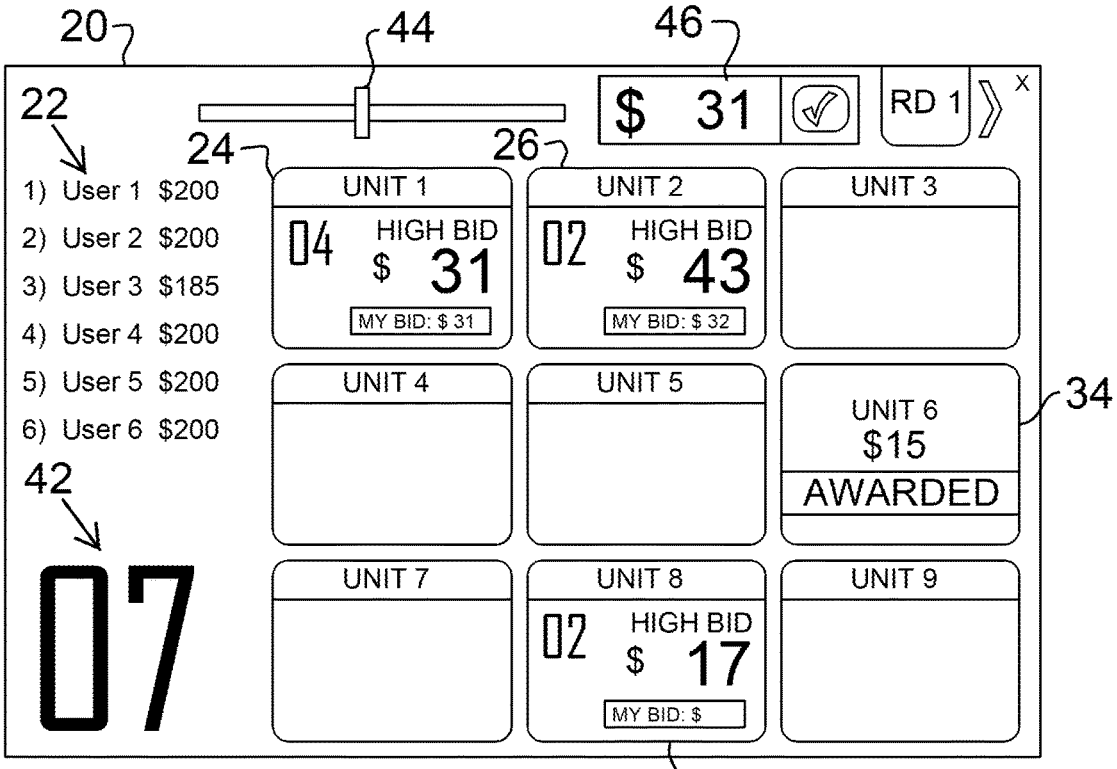
FIG. 9 depicts the graphical user interface, in a later stage of the group auction.

Still viewing FIG. 9, 7 second remain on the auction countdown timer (42), and bidding is active in sub-auction units (24, 26, and 38). The first user has placed a bid of $31 on Unit 1 in sub-auction unit (24), and four second remain on the sub-auction counterbid timer (58). The first user could have entered the $31 bid manually into the user bid box (46) or by selecting the bid slider interface (44) and sliding it to the right to increase the bid. Because the user sub-auction bid box (54) for sub-auction unit (38), remains blank, this indicates that the first user is not placing bids on unit 8. Thus, the first user has placed bids on sub-auction unit (24), sub-auction unit (26), and sub-auction unit (34) in the first round.

FIG. 10 illustrates the GUI (20), from the point of view of the fifth user or User 5, in a silent or confidential auction. Here, it can be seen that Units 1, 2, 6, and 8 have been awarded to different users, for example, Unit 6 has been awarded to the third user or User 3. The awarded units (shown as hatched) are unavailable in the silent auction. Units 3, 4, 5, 7, and 9 have not been awarded to any user. Thus, units 3, 4, 5, 7, and 9 are available for the silent auction, where each user without an awarded virtual player is given the opportunity to bid on these units. Or, as described above, if two players bid on the same unit the last second or two of the overall auction period, then the users will have the opportunity to place a silent bid on that unit. In this illustrated example, the fifth user has placed a bid of $24 on sub-auction units (30), for Unit 4. The fifth user may be unaware on which unit and how much the sixth user or User 6 is bidding. However, in another example, the fifth and sixth players may be able to see on which unit the opposing player is bidding. The silent auction timer (42') is generally set for a short period of time, such as five seconds.

Figure 11:
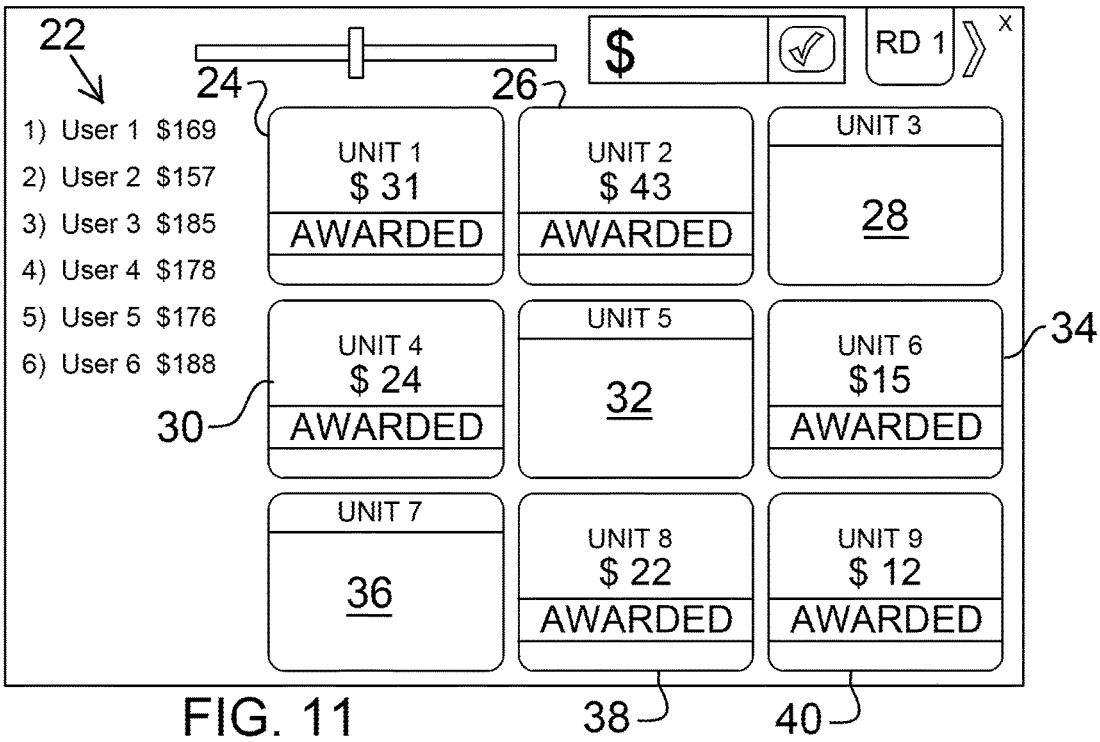
FIG. 11 depicts the graphical user interface, after the auction period and the optional silent auction period have expired.

FIG. 11 shows the GUI (20) after the auction, and any potential silent auction, has been completed. The final disposition of Round 1 is illustrated, where Units 1, 2, 4, 6, 8, and 9 have been awarded to their respective high bidder, while units 3, 5, and 7 have not been awarded because bids were not received or were withdrawn on these units. It can be seen in the user information area (22) that each user's account has been debited their winning bid amount for Round 1.

The GUI (20) of FIG. 12 illustrates the final disposition of multiple auctions in the recruitment of a fantasy football virtual team. Each user's team roster is displayed in a virtual team box (60, 62, 64, 66, 68, 70). For each position, the auction price and the projected value of each player is displayed. Further, the total projected value is displayed, by summing the projected value of each virtual player on the roster. The projected value is determined by analysis of the real-life statistical data of the associated real athlete, as described above. If a user believes that the projections are in error and to his favor, he may select the challenge button (72) to initiate a side-challenge proposition with another player, as discussed in relation to the method of FIG. 5.

Various aspects of the present invention are described herein with reference to flowchart illustrations and/or block diagrams of methods, graphical user interfaces, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which run via the processor of the computer or other programmable data processing apparatus, create means for implementing the functions/acts specified in the flowchart and/or block diagram block or blocks. These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which run on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more operable instructions for implementing the specified logical function (s). It should also be noted that, in some alternative implementations, the functions noted in the block may occur out of the order noted in the figures. For example, two blocks shown in succession may, in fact, be run substantially concurrently, or the blocks may sometimes be run in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While particular forms of the invention have been illustrated and described, it will also be apparent to those skilled in the art that various modifications can be made without departing from the spirit and scope of the invention. Accordingly, it is not intended that the invention be limited except by the claims.

What is claimed is:

1. A method of concurrently auctioning a first unit and a second unit, under control of one or more computing systems configured with executable instructions, the method comprising the steps of:

grouping, by the server, the first unit and the second unit into an auction group comprising the first unit and the second unit, wherein the auction group is homologous and wherein the auction group is a player position on a virtual team, the first unit is a first virtual player and the second unit is a second virtual player;

communicating, from a server, the auction group with a first description of the first unit and a second description of the second unit, to a first computing device associated with a first user profile and a second computing device associated with a second user profile;

granting permission, by the server, to the first user profile and the second user profile, to concurrently place bids on the first sub-auction and the second sub-auction during the auction period, where competing bids can be placed on the first unit within the first sub-auction and the second unit within the second sub-auction;

initiating, by the server, an auction period for the auction group, during which competing bids are received from the first computing device and the second computing device, a first sub-auction being restricted to the first unit and a second sub-auction being restricted to the second unit, the first sub-auction and the second sub-auction occurring during the auction period;

receiving, from the first computing device and the second computing device, competing bids on the first unit within the first sub-auction;

receiving, from the first computing device, a high bid on the first unit; and communicating, from the server, an award notification to the first computing device and the second computing device, the award notification awarding the first unit to the first user profile and the second unit to the second user profile.

2. The method of claim 1 further comprising the steps of:

receiving, from the first computing device and the second computing device, competing bids on the second unit within the second sub-auction; and receiving, from the second computing device, a second computing device high bid on the second unit.

3. The method of claim 2 wherein the auction group further comprises a third unit, a third sub-auction being restricted to the third unit, the third unit not being awarded if a bid is not received within the third sub-auction.

4. The method of claim 2, further comprising the steps of:

granting permission, by the server, to the first user profile, the second user profile, and a third user profile associated with a third computing device, to further concurrently place bids on a third sub-auction during the auction period, where competing bids can be further placed on the third unit within the third sub-auction;

failing to receive a third computing device high bid, from the third computer, on the first sub-auction, second sub-auction, and the third sub-auction; and communicating, from the server, a default award notification to the first computing device, the second computing device, and the third computing device, the default award notification awarding the third unit to the third user profile.

5. The method of claim 1 wherein the step of receiving a high bid on the first unit further comprises:

initiating a first sub-auction high bid period, during which the second user profile is granted permission, by the server, to place a counterbid on the first unit.

6. The method of claim 5 further comprising the step of:

setting, by the server, a first sub-auction first minimum bid increment on the first sub-auction.

7. The method of claim 6 further comprising the step of:

receiving, from the second computing device, the counterbid on the first unit;

initiating a first sub-auction second high bid period, during which the first user profile is granted permission, by the server, to place a second counterbid on the first unit;

receiving, from the first computing device, the second counterbid on the first unit;

initiating a first sub-auction third high bid period, during which the second user profile is granted permission, by the server, to place a third counterbid on the first unit;

ending the first sub-auction third high bid period when the third counterbid is not received, by the server, from the second computer; and terminating, by the server, permission to place bids within the first sub-auction, while continuing permission to place bids within the second sub-auction.

8. The method of claim 7 wherein prior to the step of terminating permission to place bids within the first sub-auction, the method further comprising the step of:

setting, by the server, a second sub-auction first minimum counterbid increment on the first sub-auction.

9. The method of claim 1 wherein a current high bid can be received, by the server, on the first unit within the first sub-auction transmitted through either the first user profile or the second user profile during the auction period, the current high bid capable of being exceeded by a counterbid, the method further comprising the steps of:

receiving bid activity during a predetermined time period just prior to an end of the auction period; and initiating an overtime period, during which a first confidential bid is received, by the server, from the first computing device and a second confidential bid is received, by the server, from the second computing device, wherein the first confidential bid is the high bid.

10. A method of concurrently auctioning a first unit and a second unit, under control of one or more computing systems configured with executable instructions, the method comprising the steps of:

communicating, by the server, a homologous auction group to a first computer and a second computer, the first computer associated with a first user profile and the second computer associated with a second user profile, the homologous auction group comprising the first unit and the second unit, wherein the auction group is a player position on a virtual team, the first unit is a first virtual player and the second unit is a second virtual player;

initiating, by the server, an auction period, a first sub-auction and a second sub-auction at least partially co-occurring during the auction period, the first sub-auction being restricted to the first unit and a second sub-auction being restricted to the second unit; and communicating permission, by the server, to the first computer and the second computer, to each concurrently place bids on the first sub-auction and the second sub-auction during the auction period, where competing bids are placed on the first unit within the first sub-auction and the second unit within the second sub-auction; and communicating, from the server, an award notification to the first computer and the second computer, the award notification awarding the first virtual player to the first user profile and the second virtual player to the second user profile.

11. The method of claim 10 further including the steps of:

initiating, by the server, a second auction period, a third sub-auction and a fourth sub-auction at least partially co-occurring during the second auction period, the first sub-auction being restricted to a third virtual player and a second sub-auction being restricted to a fourth virtual player, the second auction period being carried out by similar steps to the auction period;

communicating, from the server, a second award notification to the first computer and the second computer, the second award notification awarding the third virtual player to the first user profile and the fourth virtual player to the second user profile; and assembling, by the server, a first user team comprising the first virtual player and the third virtual player; and assembling, by the server, a second user team comprising the second virtual player and the fourth virtual player.

* * * * *